US007895676B2

(12) United States Patent
Clark

(10) Patent No.: US 7,895,676 B2
(45) Date of Patent: Mar. 1, 2011

(54) MALE UNDERGARMENTS WITH DIFFERENT POUCH SIZES FOR A GIVEN WAIST SIZE

(75) Inventor: Robert Clark, Blacksburg, VA (US)

(73) Assignee: Skiviez, Inc., Blacksburg, VA (US)

( * ) Notice: Subject to any disclaimer, the term of this patent is extended or adjusted under 35 U.S.C. 154(b) by 1071 days.

(21) Appl. No.: 11/657,653

(22) Filed: Jan. 25, 2007

(65) Prior Publication Data

US 2008/0178368 A1 Jul. 31, 2008

(51) Int. Cl.
*A42B 9/02* (2006.01)

(52) U.S. Cl. ..... 2/403; 2/78.1; 2/405

(58) Field of Classification Search ..... 2/227, 236, 2/237, 400–408, 466; 602/67–72; 450/58, 450/60

See application file for complete search history.

(56) References Cited

U.S. PATENT DOCUMENTS

| | | | | | |
|---|---|---|---|---|---|
| 3,207,155 | A * | 9/1965 | Cullen | 602/67 |
| 3,283,545 | A * | 11/1966 | Simon | 66/177 |
| 3,425,420 | A * | 2/1969 | Steinberger | 450/36 |
| 3,459,181 | A * | 8/1969 | Mann | 602/67 |
| 3,517,666 | A * | 6/1970 | Atlee | 602/68 |
| 3,798,675 | A | 3/1974 | Belpaume | |
| 4,173,976 | A | 11/1979 | Bloomquist et al. | |
| 5,133,093 | A | 7/1992 | Tsuchiya | |
| 5,157,793 | A * | 10/1992 | Michels | 2/403 |
| 5,870,779 | A * | 2/1999 | Heron | 2/403 |
| 5,875,495 | A * | 3/1999 | Thrower | 2/403 |
| 6,289,520 | B1 | 9/2001 | Page | |
| 6,319,092 | B1 * | 11/2001 | Leyhe et al. | 450/36 |
| 6,353,940 | B1 | 3/2002 | Lyden | |
| 7,001,240 | B1 * | 2/2006 | Huffman-Jimenez | 450/58 |
| 7,065,797 | B1 | 6/2006 | Chen | |
| 7,178,174 | B2 * | 2/2007 | Soderstrom | 2/403 |
| 2006/0162052 | A1 | 7/2006 | Stankowski et al. | |

FOREIGN PATENT DOCUMENTS

| | | |
|---|---|---|
| FR | 2624701 | 6/1989 |

* cited by examiner

*Primary Examiner* — Katherine Moran
*Assistant Examiner* — Richale L Quinn
(74) *Attorney, Agent, or Firm* — Pillsbury Winthrop Shaw Pittman LLP

(57) ABSTRACT

The invention relates to men's underwear that provides options with respect to waist size and pouch size. The pouch size may vary in order to accommodate males of varying genital sizes. For a given waist size there may be at least two pouch sizes, wherein each pouch size is different from the other. The present invention provides multiple options for pouch size within each waist size. Therefore, rather than being limited to selecting from waist size only, providers and/or user may also select from varying pouch sizes. This effectively increases the number of undergarment options.

5 Claims, 5 Drawing Sheets

MALE UNDERGARMENTS WITH DIFFERENT POUCH SIZES FOR A GIVEN WAIST SIZE

FIELD OF THE INVENTION

The invention relates to undergarments constructed to provide different pouch sizes, to accommodate men of varying external genital sizes, for a given waist size.

BACKGROUND

Currently, men's underwear come in different waist sizes. Some men's underwear include a pouch section made for the male crotch region. The pouch section may be made in general proportion to the waist size. These dimensions are used to give the "average man" a standard fit. However, men's crotch sizes, including the external genital size, are not all the same and are not known to be dependent on waist size. That is to say, men of the same waist size may vary greatly with respect to genital sizes. Therefore, some men may not find the standard fit comfortable to wear. There is no current solution that gives men of varying genital sizes a fit that does not cause excessive binding or that does not drape off of them.

SUMMARY

The current invention resolves these and other problems of existing men's underwear by providing, among other things, undergarments with two or more different pouch sizes for a given waist size. One embodiment of the invention relates to men's underwear constructed with at least a waist size and a pouch size, wherein the two sizes may be sized independently of each other. The undergarment may be constructed of a pouch section, a base section, and a waist line section. The pouch section is located at the crotch region while the waist line section is meant to be worn around or near the user's waist line. The base section may form the rear and side portions of the undergarment. The pouch section may include at least two panels (which may or may not be substantially identical) joined along their respective outwardly extending inner borders to form a curved shape seam in the middle of the undergarment and/or user's crotch region. The seam length may be measured from the waist line section to the bottom of the undergarment. The seam may produce a concave pouch. The pouch section may be positioned to support the male external genitals. The pouch size may be based on the seam length and panel dimensions. Other pouch size determination methods and construction techniques may be used.

In order to accommodate males having the same waist size but varying genital sizes, the pouch size may vary from one undergarment to another for the given waist size. According to another embodiment of the invention, a line of undergarments may include two or more sets of undergarments. Two or more undergarments may make up a set. Each undergarment within a set may have the same waist size but different pouch sizes. Thus, for a given waist size there may be at least two (or more) different pouch sizes.

The invention provides consumers with options with respect to pouch size and waist size. Therefore, rather than being limited to waist size options only, an underwear provider and/or user may also select from different pouch sizes for each respective waist size. This effectively increases the number of options for providing undergarments and/or for selecting from undergarments. For example, providers (e.g., underwear manufacturers and/or other undergarment providers) may provide several undergarments according to the invention and/or users may select from the provided undergarments.

BRIEF DESCRIPTION OF THE INVENTION

Figure 5A:
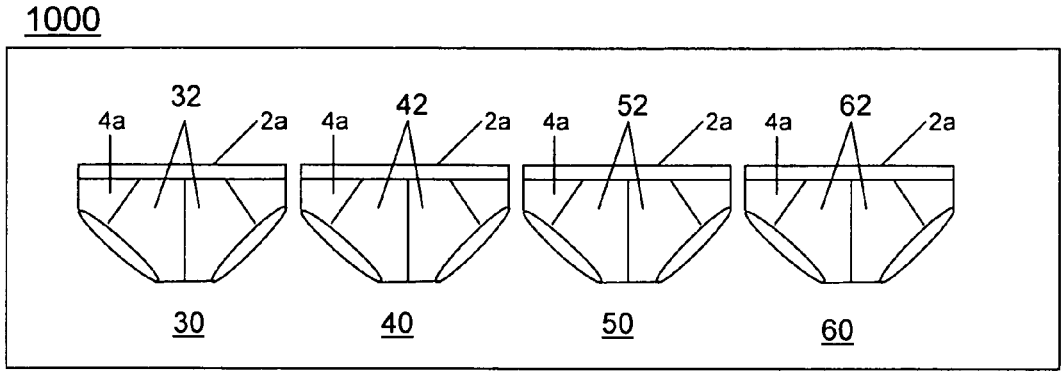
Figure 5B:
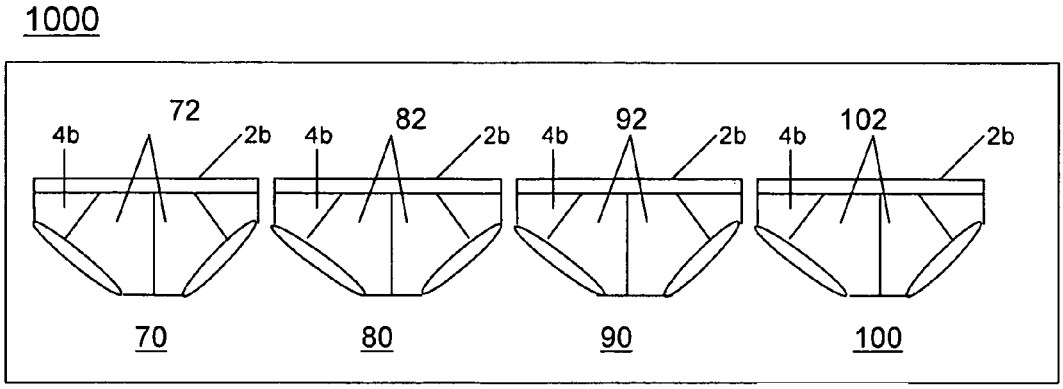

FIGS. 5*a* and 5*b* each illustrate a line of undergarments, according to an embodiment of the invention.

DETAILED DESCRIPTION

Figure 1:
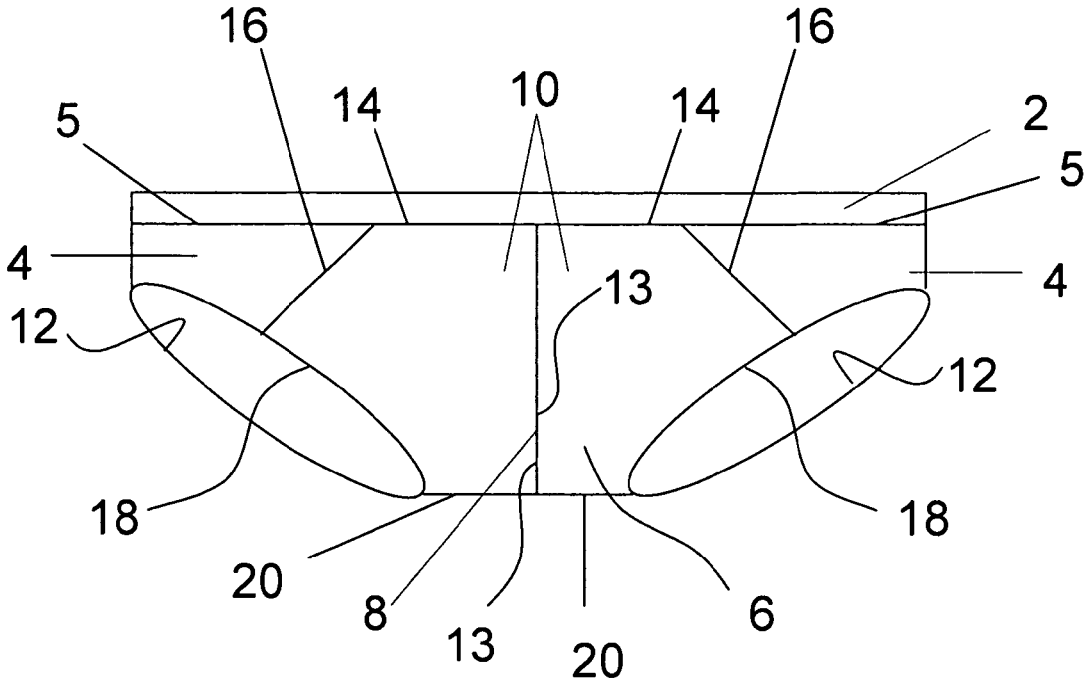
FIG. 1 is a front view of a pair of briefs, according to an embodiment of the invention.

The invention relates to men's undergarments, and particularly to providing undergarments that have different pouch sizes for a given waist size. FIG. 1 illustrates an example of a front view of an undergarment 1, according to an embodiment of the invention. While the figure illustrates briefs, the invention is not necessarily limited to a single type of undergarment and may include, but is not limited to, low rise briefs, mid-rise briefs, pouch briefs, bikini briefs, thongs, swimming briefs, swimming trunks, boxer briefs, low rise trunks, boxers, jock, long johns and/or other types of men's undergarments, which may be collectively referred to as undergarments. The undergarment 1 may include a waist line section 2; a base section 4; a pouch section 6, which may include two panels 10 (which may or may not be substantially identical); a seam length 8; and leg openings 12. The base section may include an upper border 5. Each panel 10 may include an inside border 13, a top border 14, outside border 16, leg border 18, bottom border 20 and a shared seam length 8. Other configurations may be used with the concepts of the invention.

Figure 2:
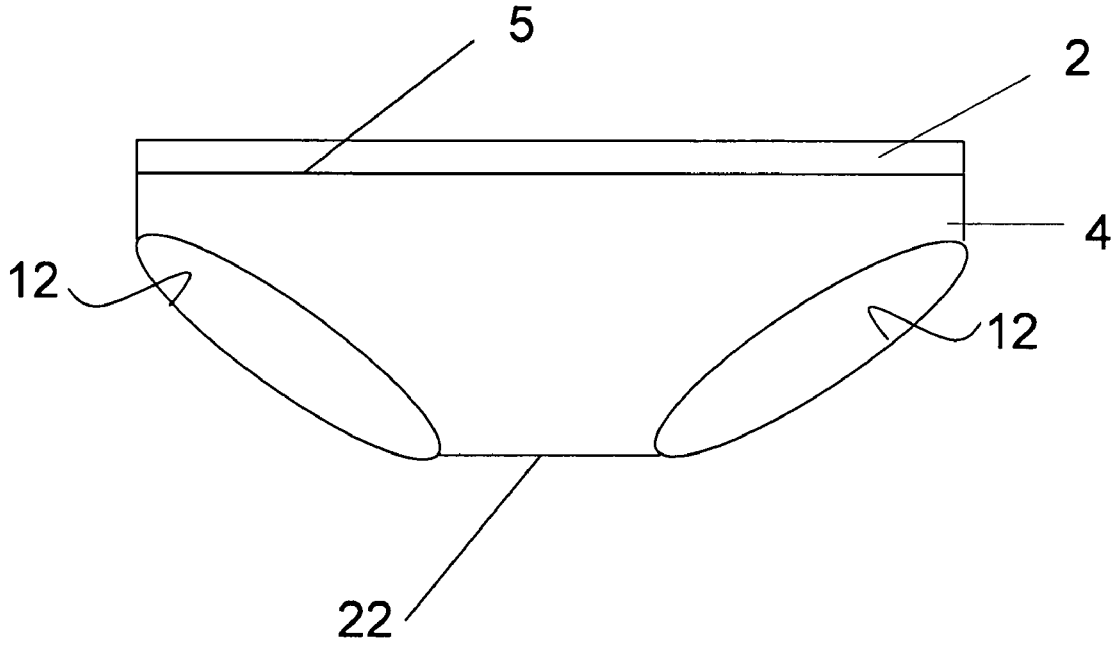
FIG. 2 illustrates a rear view of a pair of briefs, according to an embodiment of the invention.
Figure 3:
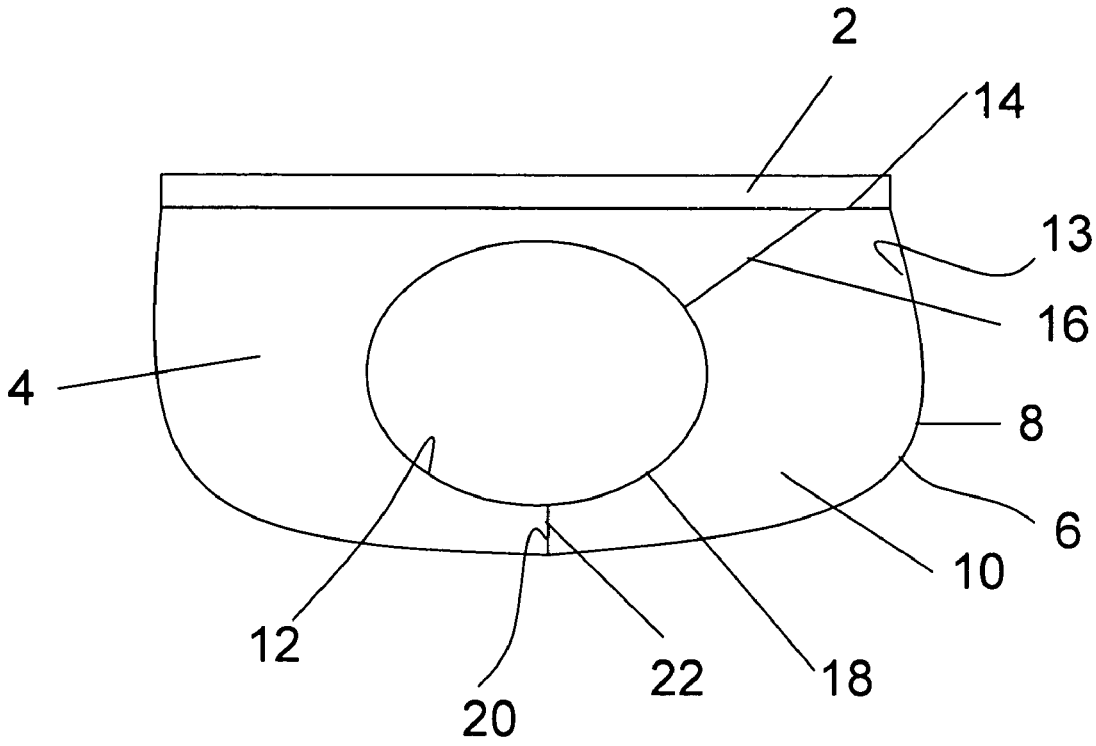
FIG. 3 is a side view of a pair of briefs, according to an embodiment of the invention.

FIG. 2 illustrates an example of a back view of the undergarment 1 shown in FIG. 1. This view shows the waist line section 2, base section 4, base section's upper border 5, base section's bottom border 22 and leg openings 12. FIG. 3 illustrates undergarment's side view including similar elements identified using like numbering. Various other construction techniques and configurations can be used.

As shown, there may be at least three sections to the undergarment 1, a waist line section 2, a base section 4 and a pouch section 6. More or fewer than three sections may be included. The sections may be joined at various locations by stitching and/or other joining mechanisms. The waist line section 2 forms the waist portion of the undergarment 1 and may be worn, based on undergarment type, around the user's waist, below the user's waist and/or above the user's waist. The waist line section 2 may be formed from appropriate material, such as fabric and/or other wearable material including, but not limited to, an elastic band. The waist line section 2 may be constructed in predetermined waist sizes. Waist sizes may range from small, medium, large, and/or extra large. Alternatively, or in addition, waist sizes may be sized according to length in inches, centimeters, and/or other unit of measure. The waist line section 2 may be joined to the base section 4 and the pouch section 6.

The base section 4 of the undergarment as shown in FIGS. 1-3 forms the rear portion (see FIG. 2) and two side portions including a left side and right side (see FIG. 1) of the undergarment 1. The base section 4 may be worn to cover the user's posterior region and side pelvic regions. The base section 4 may be formed from any appropriate material, including fabric and/or other wearable material. It may be seamless (as shown) or seamed (not shown). The base section may form part of the leg openings 12. As shown, the base section's upper border 5 may be joined with the waist line section 2 and the base section's bottom border 22 may be joined with the panels' bottom borders 20. The base section 4 may have a base size and/or dimension that correspond with the waist size such that two undergarments with the same waist size may also have substantially identical base size.

The pouch section 6 forms at least a part of the front of the undergarment 1. The pouch section 6 may be worn to cover the user's crotch region including the male genitals. This pouch section 6 may be formed of any appropriate material, including fabric and/or other wearable material. The pouch section 6 may constructed in a variety of ways. According to one example, the pouch may include two panels 10, which may or may not be substantially identical. In one example, the two panels 10 may have substantially the same size, shape, and dimension but may be attached to undergarment 1 in opposite configurations. Other construction techniques and configurations for the pouch maybe used.

As described above, each panel 10 may include an inside border 13, a top border 14, outside border 16, leg border 18, bottom border 20 and a shared seam length 8. The top border 14 of both panels may be joined with the waist line section 2. The outside borders 16 may be joined to the side portions of the base section 4 at opposite sides. The leg border 18 forms an unattached edge used to form part of the leg opening 12 for the user's right and left leg, separately. The leg border 18 may be hemmed to form a smooth border which prevents irritation and/or chaffing when worn around the user's thigh. The bottom 20 of both panels 10 may be joined with the bottom 22 of the base section 4 as shown in FIG. 2. The two panels 10 may be joined to one another on their respective inside borders 13 to form a curved seam length 8. The seam length 8 can extend in an outward direction in order to give the undergarment volume to form a pouch like portion that receives the male's external genitals. The seam length 8 may be measured along the curved seam from the panels' top border 14 to the bottom of the panels 20. A pouch size may be determined from the seam length 8 and the panels' 10 dimensions. Other size determination techniques may be used.

Figure 4:
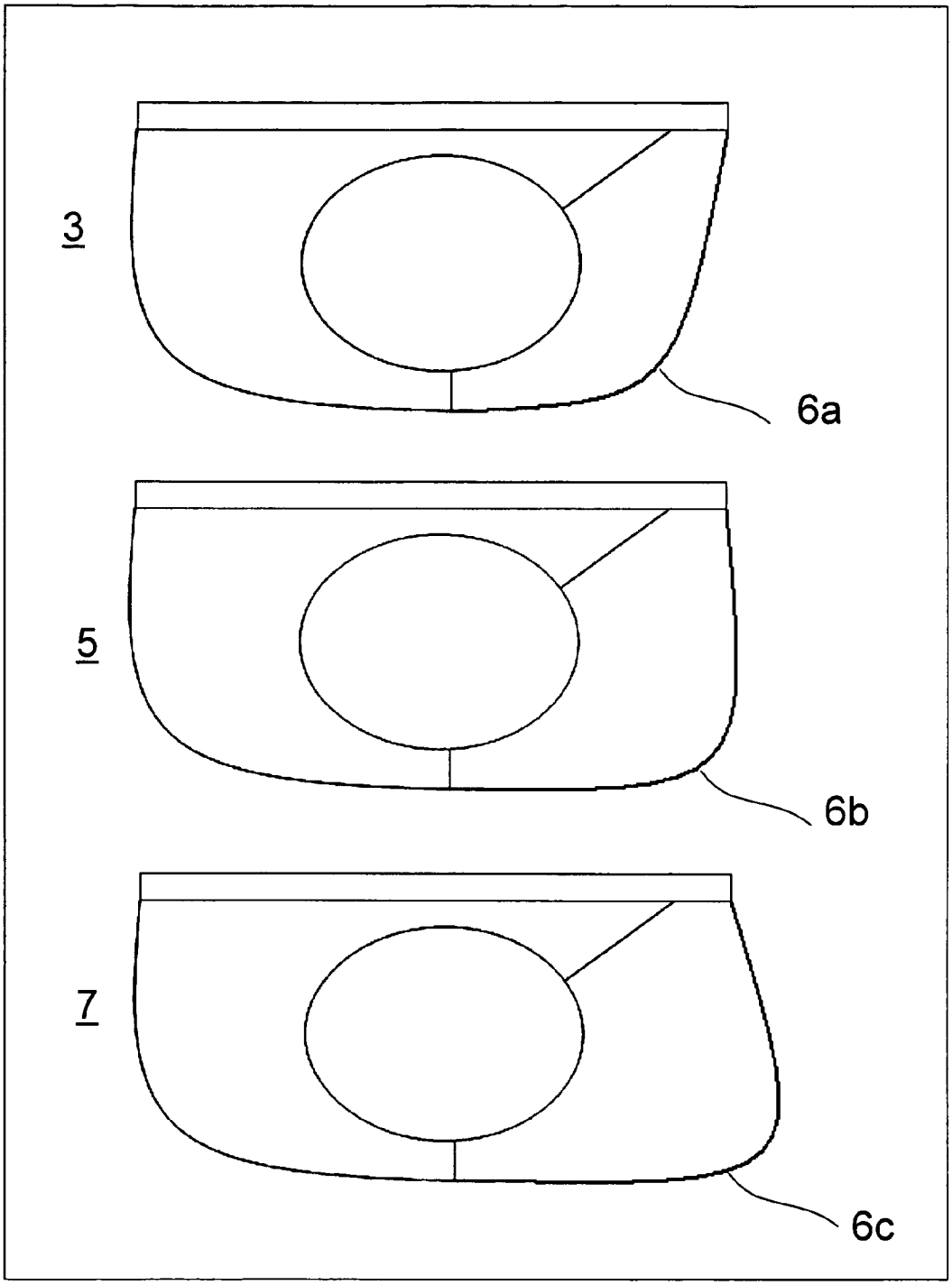
FIG. 4 illustrates varying pouch sizes, according to an embodiment of the invention.

The panels 10 may vary in proportion and/or size from one set of undergarments to another. FIG. 4 illustrates examples of side views for three undergarments (3, 5, 7). The undergarments (3, 5, 7) may each be designed to have substantially the same waist size and substantially the same base size, but each may have a different pouch size (6*a*, 6*b*, 6*c*). The pouch size may by designed to differ in size to accommodate different size male genitalia for a given waist size. According to one embodiment, the pouch size may correspond with the panels' 10 proportions. Designing the panels' dimensions to be different for a given waist size effectively results in varying the pouch size. For example, undergarments 3, 5, and 7 may be constructed to have substantially the same waist size and/or base size, but may differ by pouch size. For a given waist size, the pouch size may differ in volume (or other dimension) from one set of one or more undergarments to another set of one or more undergarments (both sets having the same waist size). In FIG. 4, pouch 6*b* may be larger than pouch 6*a*, pouch 6*c* may be larger than pouch 6*b*, and pouch 6*c* may be larger than pouch 6*a*. By way of example only, pouch 6*b* may be 50% larger than pouch 6*a*, pouch 6*c* may be 50% larger than pouch 6*b*, and pouch 6*c* may be 125% larger than pouch 6*a*. This is by way of example only, and it should be well understood by one of ordinary skill that the percentages or other differences in pouch size may be any suitable number or range of numbers.

The ability to differ the pouch sizes for a given waist size, as exemplified in FIG. 4, can result in providing a wider range of options in undergarments. The options can accommodate men of varying genital size and shape regardless of waist size. This may also provide users a more customized fit that prevents excessive bunching or binding of the undergarments.

Another aspect of the invention relates to a line of undergarments. A line of undergarments may include a number of undergarments, where at least some of the number of undergarments have substantially the same waist size and/or base size, but different pouch sizes. Undergarments with the same waist size and/or base size may be referred to as a set. A line may include two or more different sets, wherein each set represents a different waist size.

FIG. 5*a* illustrates at least part of an undergarment line 1000 including a set of 4 undergarments (30, 40, 50, 60) having substantially the same first waist size 2*a* (and first base size 4*b*) as each other. FIG. 5*b* illustrates at least another part of the undergarment line 1000 including a set of undergarments (70, 80, 90, 100) having substantially the same second waist size 2*b* (and/or second base size 4*b*) as each other. The first waist size 2*a* may be different (e.g., longer or shorter) from second waist size 2*b*. Although only two sets of undergarments are shown for the undergarment line 1000, there can be more than two sets such that the number of sets represents a number of different waist line sizes. In addition, although four undergarments are shown, each set may include two or more undergarments such that the number of undergarments (two or more) in the set represents different pouch sizes. The invention is not limited to a single line of undergarments. Several lines may exist based on different factors such as undergarment type (e.g., brief, boxer, trunk, etc.) and/or other design factors.

FIG. 5*a* illustrates an example of a front view of four undergarments (30, 40, 50, 60), according to an embodiment of the invention. Undergarments 30, 40, 50, and 60 may each include a pouch section (32, 42, 52, and 62) constructed of two substantially identical panels. The pouches (32, 42, 52, and 62) may be constructed to provide varying pouch sizes (and corresponding volumes) for the user of the undergarments. While the waist and base size (2*a*, 4*a*) remain constant, the pouch size may get progressively larger (or smaller) from one undergarment to the next within the set of undergarments shown in FIG. 5*a*. FIG. 4 provides a description of how different pouch sizes may differ. Although not drawn to scale, each undergarment within a set may have a different pouch size. For example each pair of panels 10 used to construct the pouches (32, 42, 52, 62) vary in proportion from one another. Other size determination techniques may be used.

In comparison to FIG. 5*a*, FIG. 5*b* illustrates a second set of undergarments for line 1000 having a different waist and base size (2*b*, 4*b*) from the first set of undergarment in line 1000. The second set of undergarment in line 1000 may include a plurality of undergarments (70, 80, 90, 100), wherein each undergarment includes a pouch (72, 82, 92, 102) made of two panels (which may or may not be substantially equal). The waist size and/or base size (2*b*, 4*b*) remain constant for each undergarment while the pouch size may get progressively larger (or smaller) from one undergarment to the next within the set of undergarments shown in FIG. 5*b*.

Pouches 32, 42, 52, and 62 may be the same or different in size in comparison to pouches 72, 82, 92, and 102, respectively. In one example, undergarments 30 and 70 may have substantially identical pouches 32 and 72, respectively. The pouches, however, need not be the same and may differ from one another. In an alternative example, the pouch 32 and 72 may differ from one another and may be based on their corresponding waist size (2*a*, 2*b*) and/or base size (4*a*, 4*b*).

An additional embodiment may include providing a garment tag attached to each undergarment. As described above, an undergarment may have a pouch size that may be independently selected and/or sized from a waist size. The pouch size and the waist size may be identified on the tag attached to the undergarment. By way of example, two undergarments may be constructed to have the same waist size but different pouch sizes. According to this example, the first undergarment may have a tag that identifies the waist size and first pouch size and the second undergarment may have a tag that identifies the waist size and the second pouch size, wherein the identified waist size is the same on both undergarments but the identified pouch sizes are different. As a further example, different pouch sizes may be identified using a series of letters (e.g., A, B, C, or X, Y, Z), numbers (1, 2, 3), words (small, medium, large) and/or other identifiable characters. Waist sizes may also be identified using a series of letters (e.g., S, M, L), words (e.g., small, medium, large), phrases, numbers, and/or other identifiable characters. Alternatively, the sizes may be referred to as standard, large and extra large to avoid any stigma to men of smaller genital sizes. The undergarment tag may include at least one identified pouch size and one identified waist size. Other information may be identified on the tag as well.

The line of undergarments may be constructed, manufactured, and assembled according to the details above or otherwise. The undergarment and its various sections may be constructed of the same or different materials including, cotton, nylon, silk, polyester, rubber, and/or synthetic blends, among other fibers.

While the above detailed description of the invention contains many specificities, these should not be construed as limitations on the scope of the invention, but rather as exemplifications of several preferred embodiments thereof. Many other variations are possible. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A line of undergarments including at least a first set of undergarments, the first set of undergarments comprising:

a first undergarment having:

a first waist section having a first waist size;

a first base section coupled to said first waist section and including a first rear portion, and first side portions, said first base section forming at least a portion of each of two first leg openings;

a first pouch section positioned between said two first leg openings and coupled to said first base section, said first pouch section having a first pouch size independent of the first waist size; and a second undergarment having:

a second waist section having a second waist size being substantially identical to said first waist size;

a second base section coupled to said second waist section and including a second rear portion, and second side portions, said second base section forming at least a portion of each of two second leg openings, said second base section being substantially identical to said first base section; and a second pouch section positioned between said two second leg openings and coupled to said second base section, said second pouch section having a second pouch size independent of the first and second waist size and which is larger than said first pouch size.

2. The line of undergarments of claim 1, further comprising a second set of undergarments, the second set of undergarments comprising:

a third undergarment having:

a third waist section having a third waist size being larger than said first waist size;

a third base section coupled to said third waist section and including a third rear portion, and third side portions, said third base section forming at least a portion of each of two third leg openings, said third base section being larger than said first base section; and a third pouch section positioned between said two third leg openings and coupled to said third base section, said third pouch section having a third pouch size independent of the third waist size; and a fourth undergarment having:

a fourth waist section having a fourth waist size being substantially identical to said third waist size;

a fourth base section coupled to said fourth waist section and including a fourth rear portion, and fourth side portions, said fourth base section forming at least a portion of each of two fourth leg openings, said fourth base section being substantially identical to said third base section; and a fourth pouch section positioned between said two fourth leg openings and coupled to said fourth base section, said fourth pouch section having a fourth pouch size independent of the third and fourth waist size and, which is larger than said third pouch size.

3. The line of undergarments of claim 2, wherein:

the first pouch size is substantially equal to the third pouch size; and the second pouch size is substantially equal to the fourth pouch size.

4. The line of undergarments of claim 2, wherein:

the first pouch size is different from the third pouch size; and the second pouch size is different from the fourth pouch size.

5. A line of undergarments, comprising:

a first set of undergarments including at least a first undergarment and a second undergarment, each having:

a waist section having a first waist size;

a base section coupled to said waist section and including a rear portion, and side portions, said base section forming at least a portion of each of two leg openings; and a pouch section positioned between said two leg openings and coupled to said base section and said waist section, said pouch section having a pouch size independent of the first waist size, wherein the first undergarment has a first pouch size and the second undergarment has a second pouch size, and wherein the first pouch size is different from the second pouch size; and a second set of undergarments including at least a third undergarment and a fourth undergarment, each having:

a second waist section having a second waist size that is different than the first waist size;

a second base section coupled to said second waist section and including a second rear portion, and second side portions, said second base section forming at least a portion of each of two second leg openings; and a second pouch section positioned between said two second leg openings and coupled to said second base section and said second waist section, said second pouch section having a pouch size independent of the first waist size, wherein the third undergarment has a third pouch size and the fourth undergarment has a fourth pouch size, and wherein the third pouch size is different from the fourth pouch size.

* * * * *